US011187489B1

(12) United States Patent
Wu et al.

(10) Patent No.: US 11,187,489 B1
(45) Date of Patent: Nov. 30, 2021

(54) MECHANICAL PNEUMATIC VALVE SYSTEM OF PAINTBALL GUN

(71) Applicants: Chun-Min Wu, Tainan (TW); Michael Steven Spurlock, Crestview, FL (US)

(72) Inventors: Chun-Min Wu, Tainan (TW); Michael Steven Spurlock, Crestview, FL (US)

( * ) Notice: Subject to any disclaimer, the term of this patent is extended or adjusted under 35 U.S.C. 154(b) by 0 days.

(21) Appl. No.: 17/078,289

(22) Filed: Oct. 23, 2020

(51) Int. Cl.
*F41B 11/723* (2013.01)

(52) U.S. Cl.
CPC ..... *F41B 11/723* (2013.01)

(58) Field of Classification Search
CPC ..... F41B 11/62; F41B 11/72; F41B 11/723; F41B 11/71; F41B 11/64; F41A 3/58; F41A 3/66; F41C 7/11
USPC ..... 124/71–77, 56
See application file for complete search history.

(56) References Cited

U.S. PATENT DOCUMENTS 6,708,685 B2 * 3/2004 Masse ..... F41B 11/57 124/75
6,889,681 B1 * 5/2005 Alexander ..... F41B 11/52 124/72
6,959,703 B1 * 11/2005 Spurlock ..... F41B 11/724 124/73
8,256,406 B1 * 9/2012 Kirkpatrick ..... F41B 11/723 124/73
11,112,207 B2 * 9/2021 Malheiros ..... F41B 11/723
2004/0065310 A1 * 4/2004 Masse ..... F41B 11/723 124/75
2005/0066952 A1 * 3/2005 Lai ..... F41B 11/57 124/57
2005/0193999 A1 * 9/2005 Lai ..... F41B 11/73 124/71
2006/0097211 A1 * 5/2006 Spurlock ..... F41B 11/72 251/129.15
2007/0017497 A1 * 1/2007 Masse ..... F41B 11/721 124/73
2009/0241929 A1 * 10/2009 Italia ..... F41B 11/57 124/51.1
2009/0241931 A1 * 10/2009 Masse ..... F41B 11/721 124/76
2014/0137848 A1 * 5/2014 Kantonides ..... F41B 11/722 124/77
2014/0331984 A1 * 11/2014 Brahler, II ..... F41H 13/0006 124/76
2015/0053192 A1 * 2/2015 Italia ..... F41B 11/53 124/51.1
2015/0316345 A1 * 11/2015 Brahler, II ..... F41B 11/723 124/73
2015/0338185 A1 * 11/2015 Spurlock ..... F41B 11/71 124/51.1

(Continued)

*Primary Examiner* — Michael D David
(74) *Attorney, Agent, or Firm* — Rosenberg, Klein & Lee

(57) ABSTRACT

A mechanical pneumatic valve system of a paintball gun is disclosed herein. It comprises a trigger activated valve body, a firing control valve body connected at a top of the trigger activated valve body, a firing control piston disposed in the firing control valve body, a push pilot piston positioned at a posterior end of the firing control piston and having a diameter greater than a diameter of the firing control piston, a dump chamber air reservoir communicated with the trigger activated valve body and having a volume adjustable piston to increase or decrease a volume of the dump chamber air reservoir, and a dump chamber control valve piston housed in the trigger activated valve body.

13 Claims, 7 Drawing Sheets

(56) References Cited

U.S. PATENT DOCUMENTS

| | | | | |
|---|---|---|---|---|
| 2016/0076850 | A1* | 3/2016 | Sullivan | F41B 11/723<br>124/63 |
| 2018/0172392 | A1* | 6/2018 | Malheiros | F41B 11/68 |
| 2018/0180377 | A1* | 6/2018 | Lort | F41B 11/62 |
| 2020/0141672 | A1* | 5/2020 | Silva | F41B 11/71 |

* cited by examiner

MECHANICAL PNEUMATIC VALVE SYSTEM OF PAINTBALL GUN

BACKGROUND OF THE INVENTION

1. Field of the Invention

The present invention relates to a mechanical pneumatic valve system of a paintball gun which has a trigger activated valve body and a dump chamber air reservoir to adjust air volume by a volume adjustable piston so as to mimic the function of the solenoid and electronic control circuit and achieve the effects of lowering the cost of manufacturing without reducing a high level of functionality.

2. Description of Related Art

The game of paintball has been in existence more than thirty years and with the evolving technologies the guns/markers have also evolved in their functionality. Early in the technical field of paintball markers, all conventional paintball markers were mechanical type firing systems and were a bit heavy and their shot cycles were slow due to mechanical design simplicity. As the game evolved so did the technologies around making the paintballs more brittle, so that the impact was less and less painful when hits. Because of this development of more brittle paintballs it became necessary for the guns/markers to evolve to shoot more brittle balls without the ball breaking in the guns.

The next trend in the development of the markers was to design a firing system that when the trigger was pulled instead of it firing through a mechanical release firing system, the trigger would touch a switch much like the microswitch in a computer mouse. A circuit board with a microprocessor was connected to the switch to receive a firing signal. The processor would also have a sensor mounted in proximity to the breech of the gun and could sense if there was a ball loaded fully into the breech before allowing a firing process to occur. This would greatly reduce the risk of the bolt firing system to impact a paintball when not fully loaded in the breech.

The bolt systems in most conventional paintball guns forward pressure when fired would break a ball if not fully loaded into the breech. The highest functioning paintball guns have perfected this function and could allow a rapid firing without breaking balls in the gun. However, as the technologies allowed for this evolution in design, the cost to produce these paintball guns increased substantially. One of the key components used in the firing system to control the pneumatics is a solenoid. The solenoid when coupled to the micro processing circuit can control the bolt firing system that pushes a paintball into the forward breech and dumps the air chamber to fire the ball.

For the reason of cost and precise functional control of the marker/gun firing system the current development and invention was needed. A new control pulse valve has been the focus of development and is a "completely" mechanical pneumatic valve that serves as a replacement to the solenoid valve and microprocessor control system. This new control pulse valve is substantially different from any other conventional mechanical control valves available in the market today.

Because the solenoid is mainly used for control of the pneumatic bolt firing system to move the bolt to the firing position and fire the ball, and also return the bolt to the rest position to allow another ball to enter the breech, the solenoid operates the bolt firing system like a pneumatic cylinder in two directions. This is easily done with electronics to turn on the valve and control how long the valve is enabled in the on cycle and we call this "dwell", so the electronics have predetermined dwell setting to control the bolt movement to fire the ball and return the bolt system to the rest position.

Available conventional mechanical actuated valves in the market today for use to control the cycling of a paintball pneumatic bolt firing system still have some problems as below for instance:

1. When a conventional mechanical valve would be actuated, it would control the firing sequence of the firing system when the trigger is pulled, but would keep the bolt firing system in a forward breech position until the trigger is released and the valve reversed its pneumatic control direction. This would limit how fast another ball could be loaded into the gun breech for the next shot.

2. If users fire a conventional paintball gun, release its trigger and attempt to fire again before a bolt had returned fully, a ball wouldn't have loaded causing the next shot to be in a state of "dry-firing", which means a firing sequence has occurred but a projectile wasn't fired due to no loading of balls.

SUMMARY OF THE INVENTION

In view of the above-mentioned problems, the object of the present invention is to provide a mechanical pneumatic valve system of a paintball gun, which has a trigger activated valve body and a dump chamber air reservoir to adjust air volume by a volume adjustable piston so as to mimic the function of the solenoid and electronic control circuit and achieve the effects of lowering the cost of manufacturing without reducing a high level of functionality.

The mechanical pneumatic valve system of a paintball gun of the present invention is installed on a trigger and comprises a trigger activated valve body having a first port, a third port, a fourth port and a vent port; a firing control valve body connected at a top of the trigger activated valve body and having an air source input port for an inflow of compressed air, and a control port for controlling a direction of an air flow; a firing control piston disposed in the firing control valve body; a push pilot piston positioned at a posterior end of the firing control piston and having a diameter greater than a diameter of the firing control piston; a dump chamber air reservoir connected at a bottom of the trigger activated valve body and communicated with the trigger activated valve body by the third port and the fourth port; and a dump chamber control valve piston housed in the trigger activated valve body.

Preferably, the dump chamber air reservoir has a volume adjustable piston to increase or decrease a volume of the dump chamber air reservoir, and the compressed air flows from the trigger activated valve body into the dump chamber air reservoir through the third port or flows out of the dump chamber air reservoir through the fourth port when the trigger is at rest or activated respectively.

Preferably, the dump chamber control valve piston is pressed by the trigger to move when the trigger is activated and shuts off the compressed air flowing into the dump chamber air reservoir to release the compressed air from the dump chamber air reservoir through the fourth port to fill a space behind the push pilot piston in the firing control valve body and force the push pilot piston to move forward along with the firing control piston.

Accordingly, when a firing sequence happens by pulling the trigger that the present invention would fully cycle even if the trigger wasn't released. This would insure that the bolt firing system would fully cycle and load the next projectile faster than the user could release the trigger and initiate a second firing sequence. With the new valve design, the present invention can achieve a fast cycle rate to allow the user to fire rapidly without breaking balls inside the gun breech.

DETAILED DESCRIPTION OF THE PREFERRED EMBODIMENT

Hereinafter, an exemplary embodiment of the present invention will be described in detail with reference to the accompanying drawings.

Figure 1:
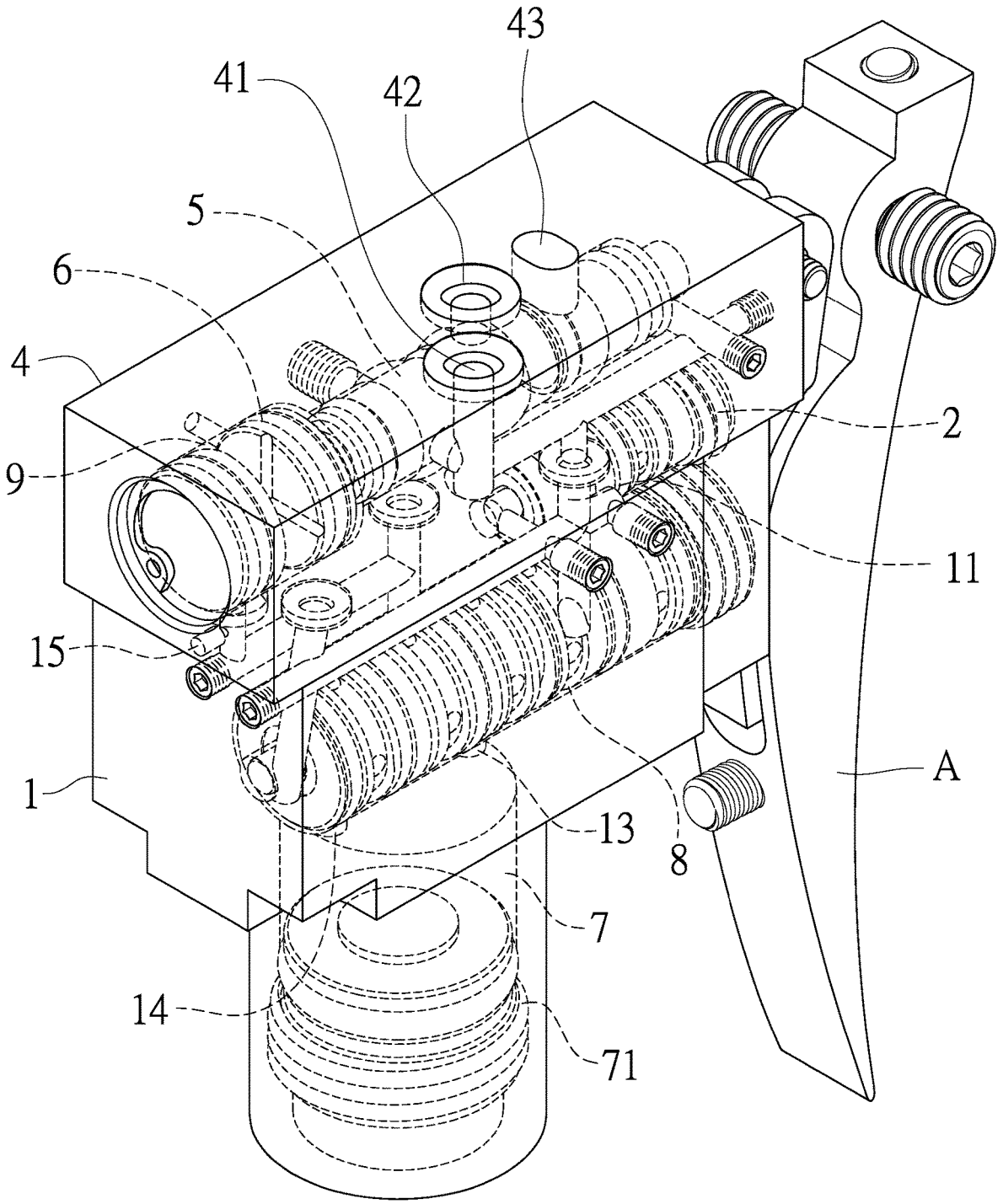
FIG. 1 is a perspective diagram showing a first embodiment for a mechanical pneumatic valve system of a paintball gun according to the present invention.
Figure 2:
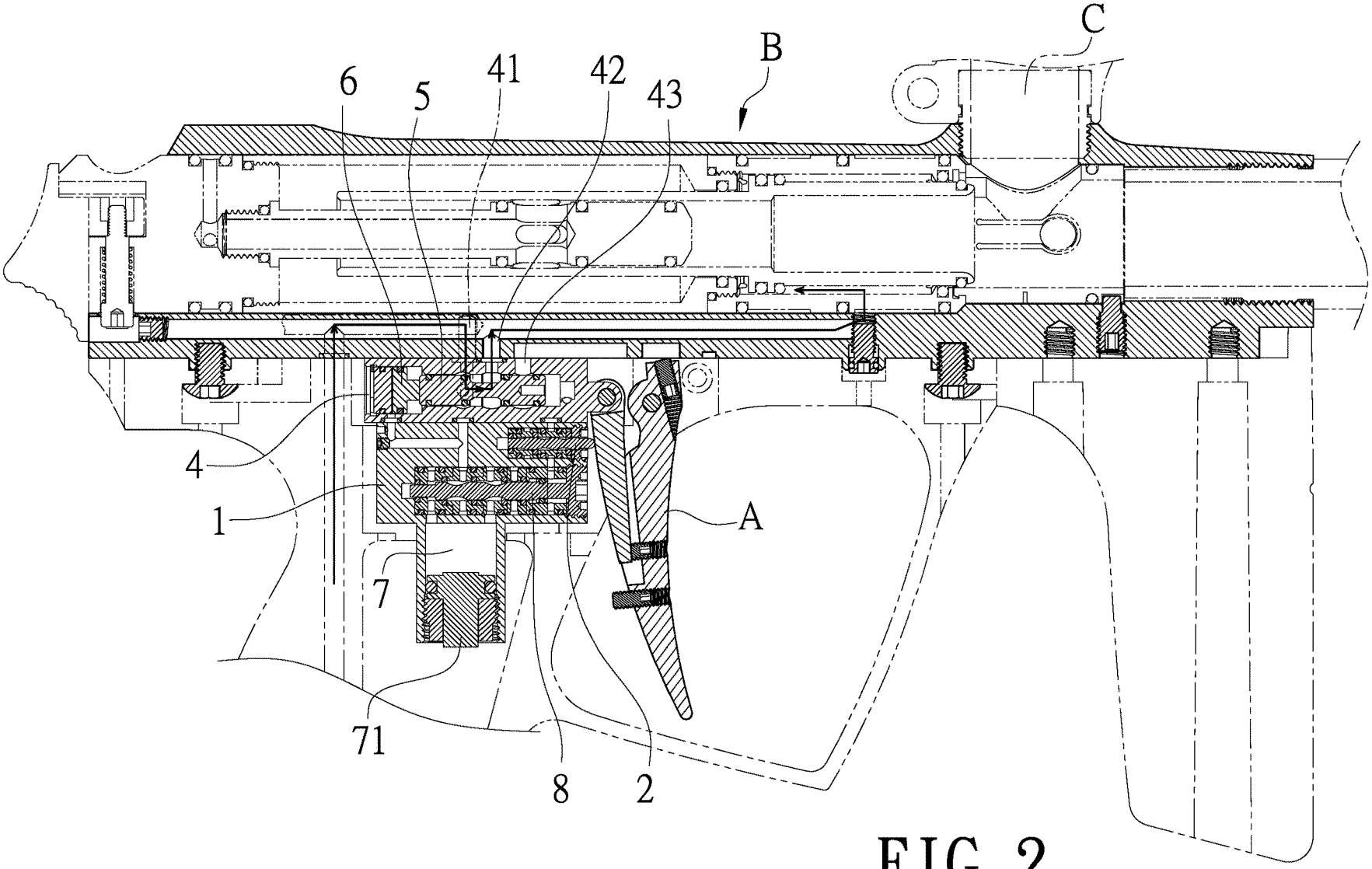
FIG. 2 is a sectional view showing the first embodiment for a mechanical pneumatic valve system of a paintball gun in use and at rest.
Figure 3:
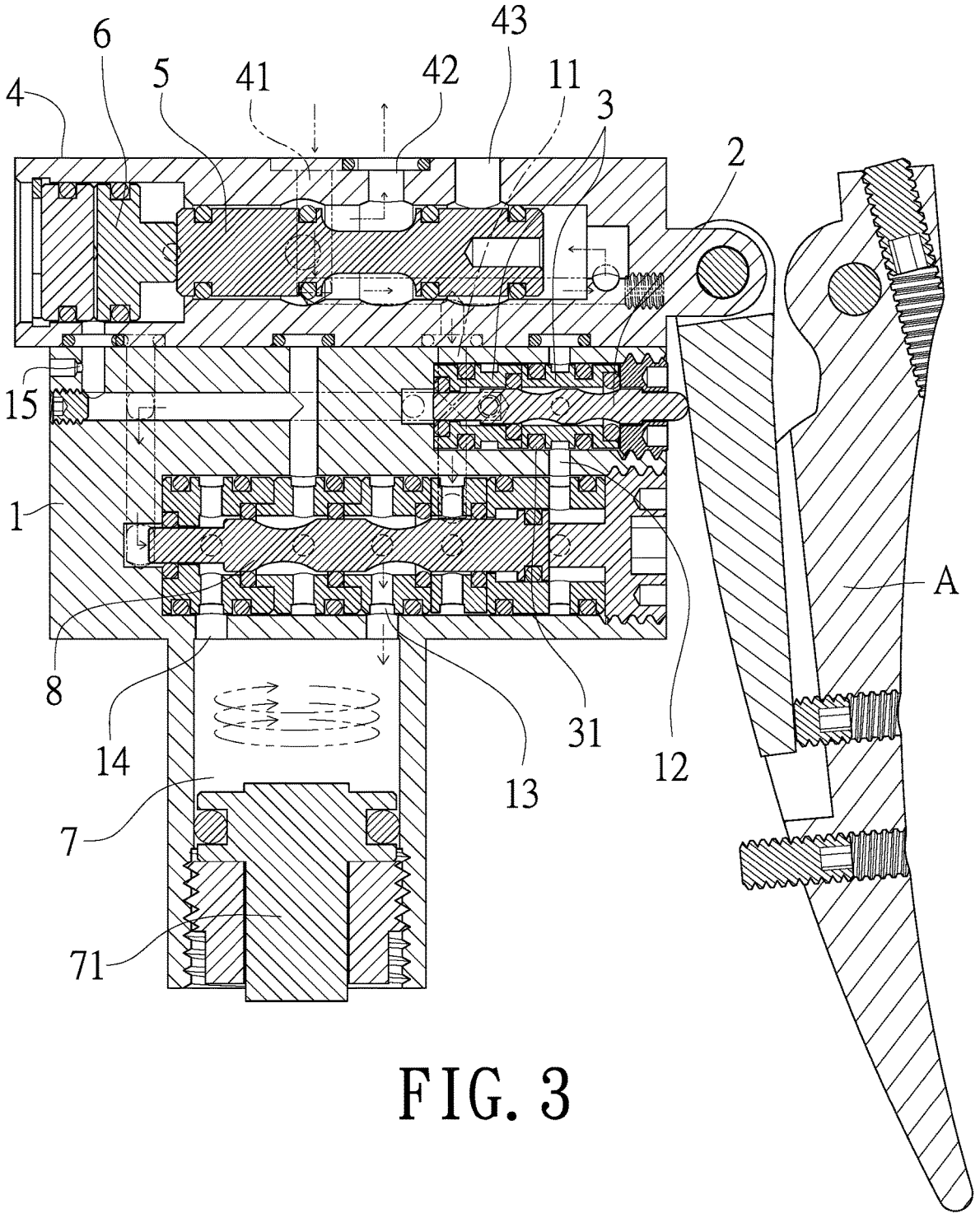
FIG. 3 is a sectional view showing the first embodiment for a mechanical pneumatic valve system of a paintball gun at rest according to the present invention.

As showed in FIG. 1 to FIG. 3, a mechanical pneumatic valve system of a paintball gun is disclosed herein. It comprises a trigger activated valve body (1), a firing control valve body (4) connected at a top of the trigger activated valve body (1), a firing control piston (5) disposed in the firing control valve body (4), a push pilot piston (6) positioned at a posterior end of the firing control piston (5) and having a diameter greater than a diameter of the firing control piston (5), a dump chamber air reservoir (7) communicated with the trigger activated valve body (1) and having a volume adjustable piston (71) to increase or decrease a volume of the dump chamber air reservoir (7), and a dump chamber control valve piston (8) housed in the trigger activated valve body (1). Furthermore, the present invention can be optionally provided with a valve trigger piston (2). The design of the valve trigger piston (2) allows the user to exert a reduced force on the trigger (A), thereby increasing the speed of pressing the trigger (A) to fire the paintballs.

Furthermore, the embodiments below can further prove the practice scope of this invention, but it is not intended to limit the scope thereto.

The present invention mainly has separate three way valves working together to achieve a complete valve function. Each of these valves are counter balanced or biased with air on one end of the piston that causes the pistons to return to their rest position when the actuating force is relieved.

Embodiment One

Referring to FIG. 1 to FIG. 5, a first embodiment for a mechanical pneumatic valve system of a paintball gun according to the present invention is disclosed. The mechanical pneumatic valve system of a paintball gun is installed on a trigger (A) and comprises a trigger activated valve body (1), a valve trigger piston (2), a firing control valve body (4), a firing control piston (5) disposed in the firing control valve body (4), a push pilot piston (6), a dump chamber air reservoir (7) and a dump chamber control valve piston (8).

The trigger activated valve body (1) is provided with a first port (11) for incoming compressed air, a second port (12), a third port (13), a fourth port (14) and a vent port (15). The trigger activated valve body (1) works like an air switch. It controls the flow of the compressed air passing through to the dump chamber air reservoir (7). When the trigger activated valve body (1) is at a rest position, it allows supply air to pass to the dump chamber air reservoir (7), and when the valve trigger piston (2) is pressed/activated, the dump chamber control valve piston (8) closes the incoming air flow to the dump chamber air reservoir (7) and opens another air passage that allows the air from the dump chamber air reservoir (7) to flow to the firing control valve body (4) and push the push pilot piston (6).

The valve trigger piston (2) is housed in the trigger activated valve body (1) and captured within plural o-ring carriers (3) to allow the compressed air to pass through the third port (13) to the dump chamber air reservoir (7). Additionally, the valve trigger piston (2) is provided with plural o-rings (31), e.g. four o-rings (31). When the valve trigger piston (2) is at rest, it allows the compressed air to flow to the dump chamber air reservoir (7) as shown by the arrows in FIG. 3. When the valve trigger piston (2) is pushed or activated, incoming air passes through the second port (12) as shown by the arrows in FIG. 5 and push the dump chamber control valve piston (8) to shut off the compressed air flowing into the dump chamber air reservoir (7) and at the same time release the compressed air from the dump chamber air reservoir (7) through a fourth port (14) to the firing control valve body (4).

The firing control valve body (4) is connected at a top of the trigger activated valve body (1) and comprises two pistons, the firing control piston (5) and the push pilot piston (6). The firing control piston (5) controls the flow of the compressed air to a bolt firing system (B) of the paintball gun to retain the bolt in an open breech position.

Figure 5:
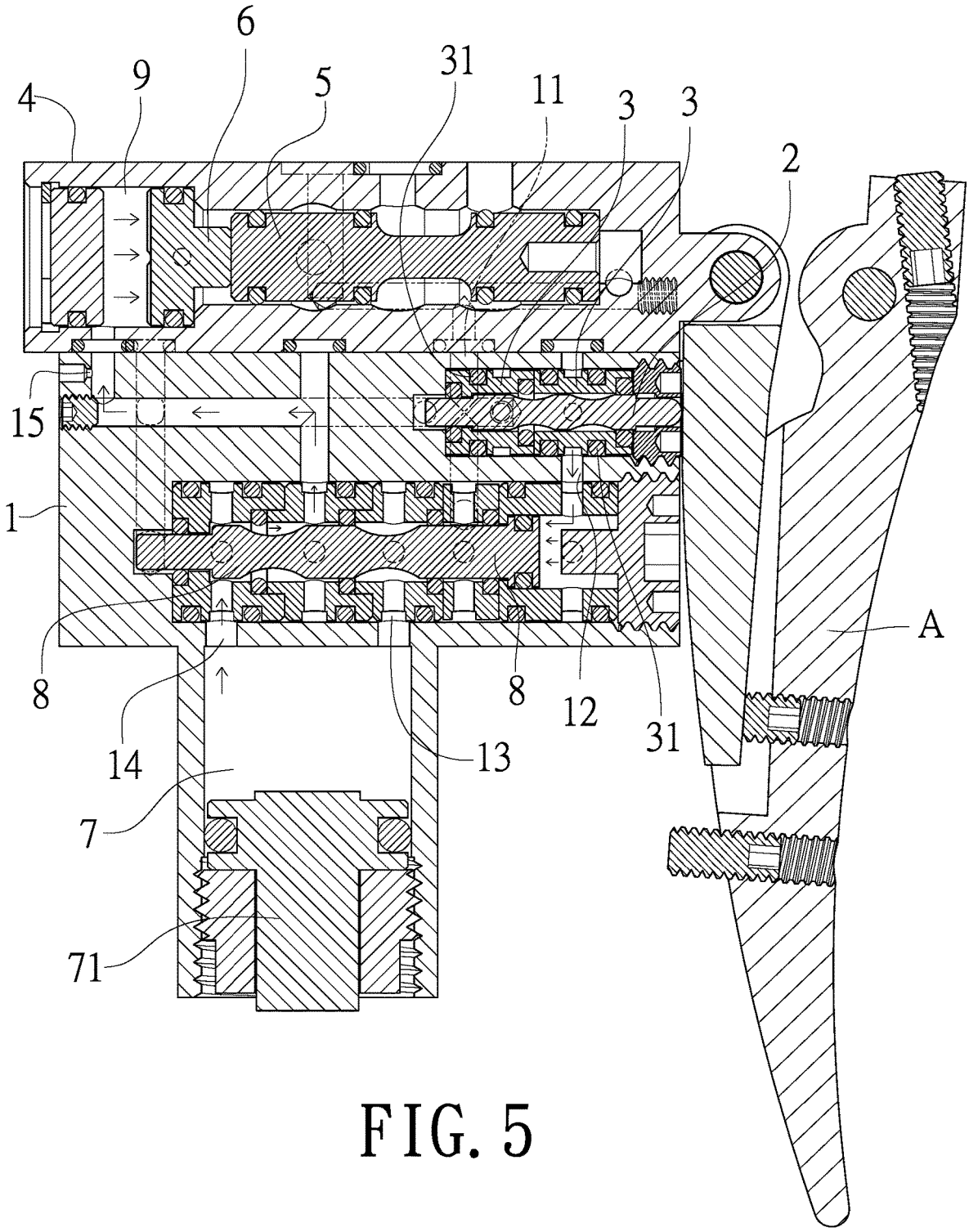
FIG. 5 is a sectional view showing the first embodiment for a mechanical pneumatic valve system of a paintball gun in an activated state according to the present invention.

The firing control valve body (4) is further provided with an air source input port (41) for an inflow of compressed air, a control port (42) and an exhaust port (43). Each of the trigger activated valve body (1) and the firing control valve body (4) is a three way valve. The control port (42) controls a direction of an air flow by exhausting the compressed air to the bolt firing system (B) when the valve trigger piston (2) is at rest, and guiding the compressed air to the exhaust port (43) for exhausting the compressed air to atmosphere when the trigger (A) and the firing control valve body (4) are actuated. As shown in FIG. 5, the firing control valve body (4) has a pilot cylinder (9) behind the push pilot piston (6). The firing control valve body (4) can also be designed to have a total of 5 or 6 ports for controlling multiple flow directions of the compressed air and supply of the air flow to the bolt firing system (B).

The push pilot piston (6) is positioned at a posterior end of the firing control piston (5). Preferably, the push pilot piston (6) has a diameter greater than a diameter of the firing control piston (5). When the valve trigger piston (2) is pushed/activated, the compressed air from the dump chamber air reservoir (7) is released to fill the space behind the push pilot piston (6) to push the push pilot piston (6) against the firing control piston (5), causing movement and change of directional flow through the control port (42) to change flow direction. At the same times the air from the dump chamber air reservoir (7) is also exhausted through the vent port (15). This small amount of air serves to move the firing control piston (5) for a short period of time until the air from the dump chamber air reservoir (7) has exhausted from behind the push pilot piston (6) through the vent port (15). The opposite end of the firing control piston (5) is also pressurized with compressed air at the same pressure as the air from the dump chamber air reservoir (7). Because the diameter of the firing control piston (5) is less than the push pilot piston (6), the return force of the firing control piston (5) is weaker than the pushing force of the push pilot piston (6), causing the air on the opposite end of the firing control piston (5) to return the firing control piston (5) back to its rest position once the air from the dump chamber air reservoir (7) is exhausted through the vent port (15).

Figure 4:
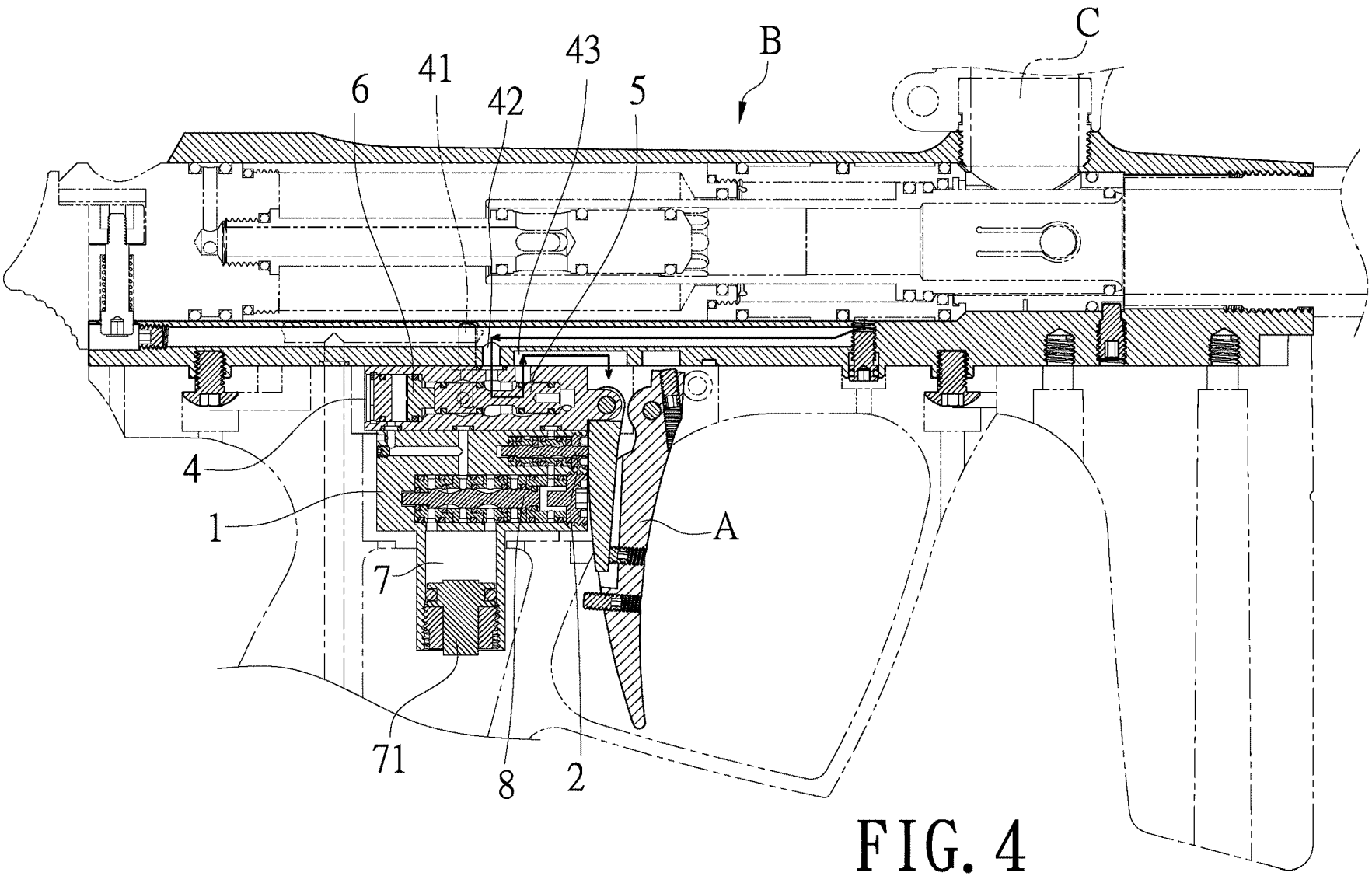
FIG. 4 is a sectional view showing the first embodiment for a mechanical pneumatic valve system of a paintball gun in use and in an activated state.

The dump chamber air reservoir (7) is connected at a bottom of the trigger activated valve body (1) and communicated with the trigger activated valve body (1) by the third port (13) and the fourth port (14). The dump chamber air reservoir (7) further has a volume adjustable piston (71) to increase or decrease a volume of the dump chamber air reservoir (7). When the trigger (A) is at rest as shown in FIG. 2 to FIG. 3, the compressed air flows from the trigger activated valve body (1) into the dump chamber air reservoir (7) through the third port (13). When the trigger (A) is activated as shown in FIG. 4 to FIG. 5, the compressed air flows out of the dump chamber air reservoir (7) through the fourth port (14). When the compressed air is release from the dump chamber air reservoir (7) and passes to the push pilot piston (6), it forces the push pilot piston (6) to move in a linear direction and the push pilot piston (6) is in connection with the firing control piston (5), causing the firing control piston (5) to move in the same direction as the push pilot piston (6).

The dump chamber air reservoir (7) may have an adjustable volume or a capped fixed volume that is not adjustable according to demands.

The dump chamber control valve piston (8) is housed in the trigger activated valve body (1). The dump chamber control valve piston (8) is pressed by the trigger (A) to move when the trigger (A) is activated and shuts off the compressed air flowing into the dump chamber air reservoir (7) to release the compressed air from the dump chamber air reservoir (7) through the fourth port (14) to fill a space behind the push pilot piston (6) in the firing control valve body (4). Thus, the push pilot piston (6) is forced to move forward along with the firing control piston (5).

In use of the present invention, an actuating force in the valve trigger piston (2) is caused by depressing the trigger (A) against the valve trigger piston (2). The valve trigger piston (2) while in the rest position blocks the flow of pressurized air. When the trigger (A) depresses the valve trigger piston (2), the valve trigger piston (2) opens a flow path to allow the compressed air to pass to the dump chamber control valve piston (8) on one side to force its movement to an open position. The dump chamber control valve piston (8) while in a rest position allows compressed air to fill the dump chamber air reservoir (7).

Furthermore, when the valve trigger piston (2) is actuated and the compressed air flows to the actuating side/end of the dump chamber control valve piston (8) causing it to be moved to an open position, it closes the input air flow to the dump chamber air reservoir (7) first, then within milliseconds opens a flow path allowing the chambered air to exit through a different flow path and this air will force the push pilot piston (6) to move and actuate the firing control piston (5).

When the trigger (A) is released, the dump chamber control valve piston (8) returns to the rest position and air refills the dump chamber air reservoir (7). During the short period, the dump chamber air reservoir (7) actuates the firing control valve body (4), the push pilot piston (6) actuates the firing control piston (5). The firing control piston (5) when in the rest position allows input compressed air to flow from the air source input port (41) to the control port (42) to keep the bolt firing system (B) in the rest position.

When the firing control piston (5) is actuated from the dump chamber air reservoir (7) being exhausted to the push pilot piston (6) and moving the firing control piston (5) to a change direction flow position, the control port (42) air is routed back through the firing control valve body (4) to the exhaust port (43) exhausting air from the control port (42) to atmosphere. In the trigger activated valve body (1), the vent port (15) to atmosphere allows the compressed air flowing from the dump chamber air reservoir (7) to exhaust at the same time that it pressurizes the pilot cylinder (9) behind the push pilot piston (6). Once the push pilot piston (6) reaches the end of its actuating stroke and the compressed air also exhausted at the same time, the compressed air loses pressure in the pilot cylinder (9) behind the push pilot piston (6). Furthermore, due to the opposite end of the firing control piston (5) being constantly pressured, the firing control piston (5) is forced to return pushing the push pilot piston (6) to its rest position as well.

If the dump chamber air reservoir (7) is adjusted to a larger volume, the valve cycle would be longer. This is measured as valve dwell timing and usually the total valve open time ranges from 5 ms-30 ms depending on the volume of the dump chamber air reservoir (7) volume. The dump chamber air reservoir (7) can also have a capped fixed volume that is not adjustable.

Embodiment Two

Figure 6:
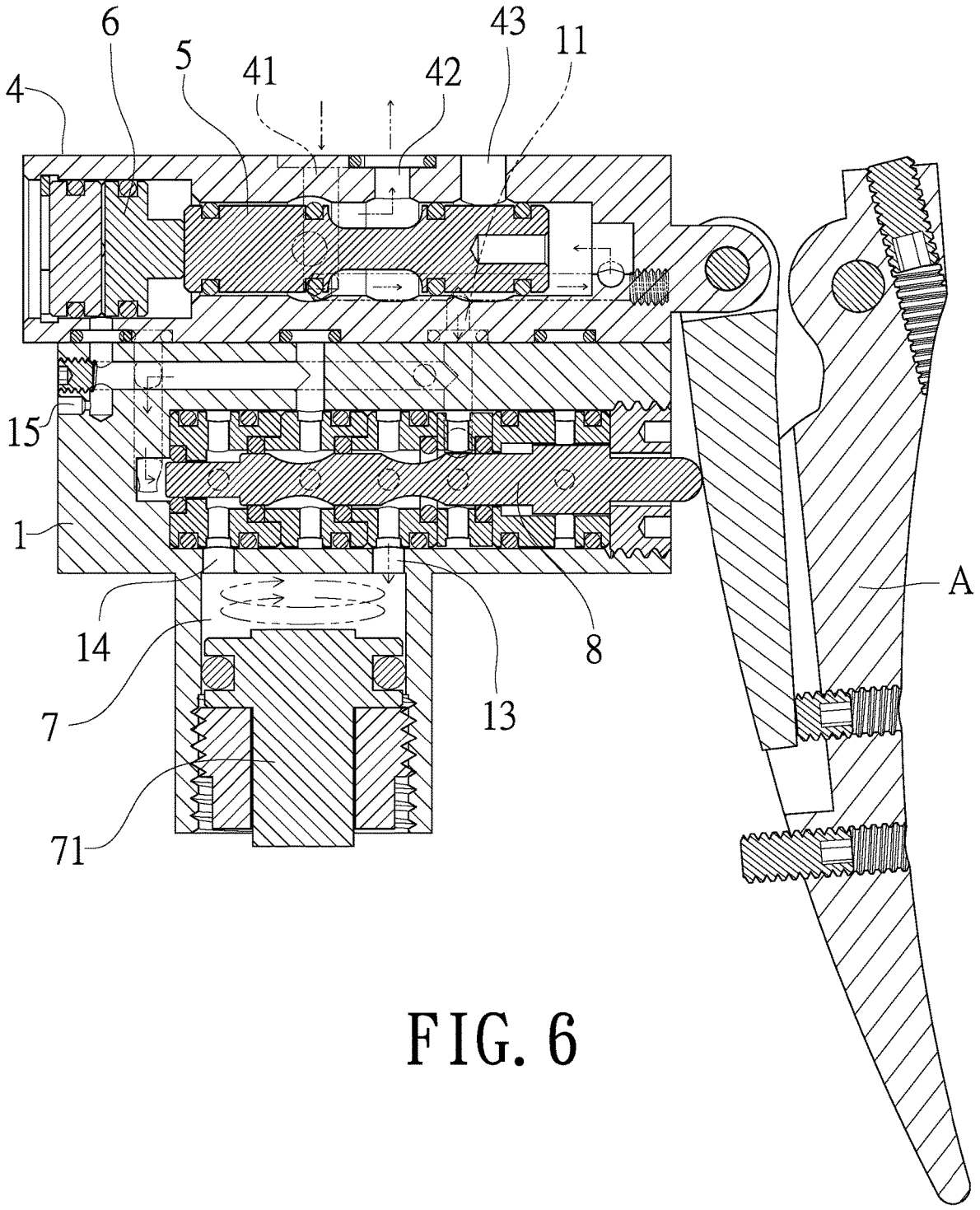
FIG. 6 is a sectional view showing a second embodiment for a mechanical pneumatic valve system of a paintball gun at rest according to the present invention.
Figure 7:
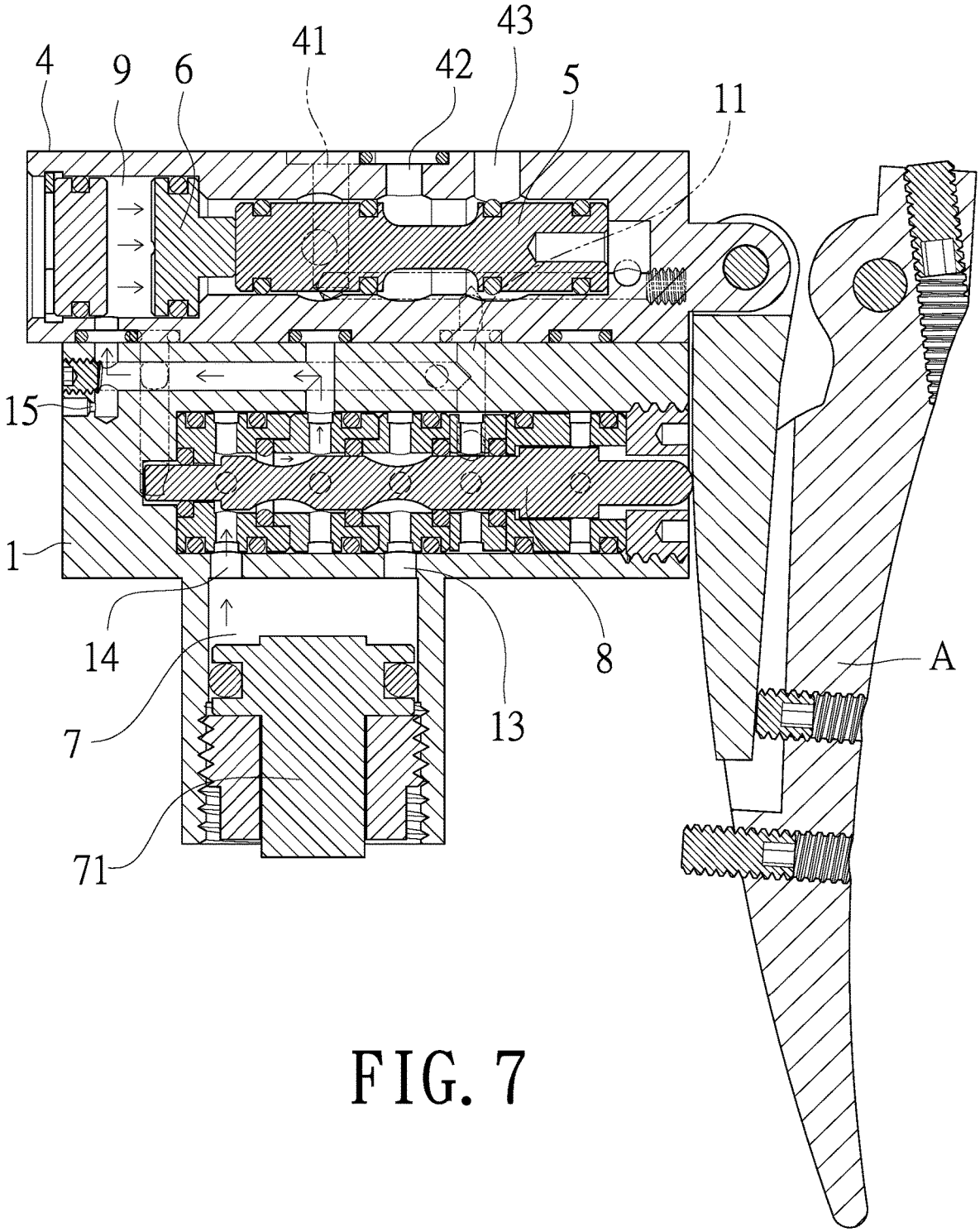
FIG. 7 is a sectional view showing the second embodiment for a mechanical pneumatic valve system of a paintball gun in an activated state according to the present invention.

Referring to FIG. 6 to FIG. 7, a second embodiment for a mechanical pneumatic valve system of a paintball gun at rest according to the present invention is disclosed. The mechanical pneumatic valve system of a paintball gun is installed on a trigger (A) and comprises a trigger activated valve body (1), a firing control valve body (4), a firing control piston (5) disposed in the firing control valve body (4), a push pilot piston (6), a dump chamber air reservoir (7) and a dump chamber control valve piston (8).

The trigger activated valve body (1) is provided with a first port (11), a third port (13), a fourth port (14) and a vent port (15). The firing control valve body (4) is connected at a top of the trigger activated valve body (1) and further provided with an air source input port (41) for an inflow of compressed air, a control port (42) and an exhaust port (43). Each of the trigger activated valve body (1) and the firing control valve body (4) is a three way valve. The control port (42) controls a direction of an air flow by exhausting the compressed air to a bolt firing system (B) when the trigger (A) is at rest, and guiding the compressed air to the exhaust port (43) for exhausting the compressed air to atmosphere when the trigger (A) and the firing control valve body (4) are actuated. As shown in FIG. 5, the firing control valve body (4) has a pilot cylinder (9) behind the push pilot piston (6). The firing control valve body (4) can also be designed to have a total of 5 or 6 ports for controlling multiple flow directions of the compressed air and supply of the air flow to the bolt firing system (B).

The push pilot piston (6) is positioned at a posterior end of the firing control piston (5). Preferably, the push pilot piston (6) has a diameter greater than a diameter of the firing control piston (5).

The dump chamber air reservoir (7) is connected at a bottom of the trigger activated valve body (1) and communicated with the trigger activated valve body (1) by the third port (13) and the fourth port (14). The dump chamber air reservoir (7) further has a volume adjustable piston (71) to increase or decrease a volume of the dump chamber air reservoir (7). When the trigger (A) is at rest as shown in FIG. 6, the compressed air flows from the trigger activated valve body (1) into the dump chamber air reservoir (7) through the third port (13). When the trigger (A) is activated as shown in FIG. 7, the compressed air flows out of the dump chamber air reservoir (7) through the fourth port (14). The dump chamber air reservoir (7) may have an adjustable volume or a capped fixed volume that is not adjustable according to demands.

The dump chamber control valve piston (8) is housed in the trigger activated valve body (1). The dump chamber control valve piston (8) is pressed by the trigger (A) to move when the trigger (A) is activated and shuts off the compressed air flowing into the dump chamber air reservoir (7) to release the compressed air from the dump chamber air reservoir (7) through the fourth port (14) to fill a space behind the push pilot piston (6) in the firing control valve body (4). Thus, the push pilot piston (6) is forced to move forward along with the firing control piston (5).

Compared with the conventional technique available now, the present invention has the following advantages:

1. The present invention uses the trigger activated valve body and the dump chamber air reservoir to adjust air volume by the volume adjustable piston, which achieves the function of the solenoid and electronic control circuit and the effects of lowering the cost of manufacturing without reducing a high level of functionality.

2. The present invention insures that the bolt firing system would fully cycle and load the next projectile faster than the user could release the trigger and initiate a second firing sequence. Therefore, even if the trigger wasn't released, a full cycle can be completed and dry-firing can be avoided.

3. The present invention achieves a fast cycle rate to allow the user to fire rapidly without breaking balls inside the gun breech.

What is claimed is:

1. A mechanical pneumatic valve system of a paintball gun, installed on a trigger, comprising:

a trigger activated valve body having a first port, a third port, a fourth port and a vent port;

a firing control valve body connected at a top of the trigger activated valve body and having an air source input port for an inflow of compressed air, and a control port for controlling a direction of an air flow;

a firing control piston disposed in the firing control valve body;

a push pilot piston positioned at a posterior end of the firing control piston and having a diameter greater than a diameter of the firing control piston;

a dump chamber air reservoir connected at a bottom of the trigger activated valve body and communicated with the trigger activated valve body by the third port and the fourth port, wherein the dump chamber air reservoir has a volume adjustable piston to increase or decrease a volume of the dump chamber air reservoir, and wherein the compressed air flows from the trigger activated valve body into the dump chamber air reservoir through the third port or flows out of the dump chamber air reservoir through the fourth port when the trigger is at rest or activated respectively; and a dump chamber control valve piston housed in the trigger activated valve body, wherein the dump chamber control valve piston moves in a direction when the trigger is activated and shuts off the compressed air flowing into the dump chamber air reservoir to release the compressed air from the dump chamber air reservoir through the fourth port to fill a space behind the push pilot piston in the firing control valve body and force the push pilot piston to move forward along with the firing control piston.

2. The mechanical pneumatic valve system of a paintball gun as claimed in claim 1, wherein each of the trigger activated valve body and the firing control valve body is a three way valve, and wherein the firing control valve body further has an exhaust port for exhausting the compressed air from the control port to atmosphere as the firing control valve body is actuated.

3. The mechanical pneumatic valve system of a paintball gun as claimed in claim 2, wherein the control port exhausts the compressed air to a bolt firing system when the trigger is at rest and guides the compressed air to the exhaust port for exhausting the compressed air to atmosphere when the firing control valve body is actuated, and wherein the firing control valve body has a pilot cylinder behind the push pilot piston.

4. The mechanical pneumatic valve system of a paintball gun as claimed in claim 1, wherein the dump chamber air reservoir has an adjustable volume or a capped fixed volume that is not adjustable.

5. The mechanical pneumatic valve system of a paintball gun as claimed in claim 1, wherein the firing control valve body has a total of 5 or 6 ports for controlling multiple flow directions of the compressed air.

6. The mechanical pneumatic valve system of a paintball gun as claimed in claim 5, wherein the firing control valve body is served for supply of the air flow to a bolt firing system.

7. A mechanical pneumatic valve system of a paintball gun, installed on a trigger, comprising:

a trigger activated valve body having a first port, a second port, a third port, a fourth port and a vent port;

a valve trigger piston housed in the trigger activated valve body and captured within plural o-ring carriers, wherein the valve trigger piston is provided with plural o-rings;

a firing control valve body connected at a top of the trigger activated valve body and having an air source input port for an inflow of compressed air, and a control port for controlling a direction of an air flow;

a firing control piston disposed in the firing control valve body;

a push pilot piston positioned at a posterior end of the firing control piston and having a diameter greater than a diameter of the firing control piston;

a dump chamber air reservoir connected at a bottom of the trigger activated valve body and communicated with the trigger activated valve body by the third port and the fourth port, wherein the dump chamber air reservoir has a volume adjustable piston to increase or decrease a volume of the dump chamber air reservoir, and wherein the compressed air flows from the trigger activated valve body into the dump chamber air reservoir through the third port or flows out of the dump chamber air reservoir through the fourth port when the valve trigger piston is at rest or activated respectively; and a dump chamber control valve piston housed in the trigger activated valve body and below the valve trigger piston, wherein the dump chamber control valve piston is forced to move in a direction away from the trigger by the compressed air passing through the second port when the valve trigger piston is activated and shuts off the compressed air flowing into the dump chamber air reservoir to release the compressed air from the dump chamber air reservoir through the fourth port to fill a space behind the push pilot piston in the firing control valve body and force the push pilot piston to move forward along with the firing control piston.

8. The mechanical pneumatic valve system of a paintball gun as claimed in claim 7, wherein the valve trigger piston is provided with 4 o-rings.

9. The mechanical pneumatic valve system of a paintball gun as claimed in claim 7, wherein each of the trigger activated valve body and the firing control valve body is a three way valve, and wherein the firing control valve body further has an exhaust port for exhausting the compressed air from the control port to atmosphere as the firing control valve body is actuated.

10. The mechanical pneumatic valve system of a paintball gun as claimed in claim 9, wherein the control port exhausts the compressed air to a bolt firing system when the valve trigger piston is at rest and guides the compressed air to the exhaust port for exhausting the compressed air to atmosphere when the firing control valve body is actuated, and wherein the firing control valve body has a pilot cylinder behind the push pilot piston.

11. The mechanical pneumatic valve system of a paintball gun as claimed in claim 7, wherein the dump chamber air reservoir has an adjustable volume or a capped fixed volume that is not adjustable.

12. The mechanical pneumatic valve system of a paintball gun as claimed in claim 7, wherein the firing control valve body has a total of 5 or 6 ports for controlling multiple flow directions of the compressed air.

13. The mechanical pneumatic valve system of a paintball gun as claimed in claim 12, wherein the firing control valve body is served for supply of the air flow to a bolt firing system.

* * * * *